United States Patent [19]

Sobieski et al.

[11] Patent Number: 4,652,114

[45] Date of Patent: Mar. 24, 1987

[54] ELECTROPHOTOGRAPHIC COPYING APPARATUS AND PROCESS

[75] Inventors: James F. Sobieski, Mahtomedi; Robert A. Muehlhausen, Marine, both of Minn.

[73] Assignee: Minnesota Mining and Manufacturing Company, St. Paul, Minn.

[21] Appl. No.: 869,685

[22] Filed: Jun. 2, 1986

Related U.S. Application Data

[62] Division of Ser. No. 720,089, Apr. 5, 1985.

[51] Int. Cl.[4] ..... G03G 15/00

[52] U.S. Cl. ..... 355/3 CH; 355/14 CH; 355/15

[58] Field of Search ..... 355/14 R, 14 CH, 3 CH, 355/15, 3 R

[56] References Cited

U.S. PATENT DOCUMENTS

| | | | |
|---|---|---|---|
| 3,637,306 | 1/1972 | Cooper | 355/15 |
| 3,647,293 | 3/1972 | Queener | 355/15 |
| 3,649,262 | 3/1972 | Cade et al. | 355/15 X |
| 3,838,921 | 10/1974 | Sargis | 355/15 |
| 4,017,170 | 4/1977 | Komori et al. | 355/3 R |
| 4,087,170 | 5/1978 | Sawaoka et al. | 355/3 CH |
| 4,129,072 | 12/1978 | Fujii et al. | 101/1 |
| 4,200,387 | 4/1980 | Masumura | 355/3 DD |
| 4,233,286 | 11/1980 | Soothill et al. | 424/12 |
| 4,240,723 | 12/1980 | Forgo | 355/3 DD |
| 4,311,780 | 6/1982 | Mochizaki et al. | 430/125 |
| 4,320,958 | 3/1982 | Fantuzzo | 355/3 DD |
| 4,335,420 | 6/1982 | Mitsuo et al. | 361/230 |
| 4,372,669 | 2/1983 | Fantuzzo et al. | 355/3 R |
| 4,432,631 | 2/1984 | Bacon et al. | 355/3 CH |
| 4,456,365 | 6/1984 | Yuasa | 355/3 CH |
| 4,465,360 | 8/1984 | Yamagishi et al. | 355/14 R |

*Primary Examiner*—A. C. Prescott

*Attorney, Agent, or Firm*—Donald M. Sell; James A. Smith; David W. Anderson

[57] ABSTRACT

An electrophotographic copying apparatus includes a copying cycle which always alternates development between two image areas to equalize wear along the length of its photosensitive belt and which eliminates a cleaning cycle after the final copy of a copying cycle to reduce belt revolutions. Also included is a combined charger/precleaner to reduce size and a light image mask to prevent unnecessary toning of the belt.

5 Claims, 4 Drawing Figures

ELECTROPHOTOGRAPHIC COPYING APPARATUS AND PROCESS

This is a division of application Ser. No. 720,089, filed Apr. 5, 1985.

BACKGROUND OF THE INVENTION

1. Field of the Invention

The present invention relates to an electrophotographic copying apparatus and process and, more particularly, to a copying process which employs a combined developing-cleaning magnetic brush unit and which produces a reversal image of the object copied.

2. Description of the Prior Art

Copying machines employing the electrophotographic process utilize a photosensitive element, usually in the form of a drum or belt, which is imagewise exposed to produce a latent electrostatic image upon the photosensitive element. Toner particles are transferred to the electrostatic image by means of a developer unit and are again transferred to a final receptor, usually a sheet of plain bond paper, to produce a permanent copy of the object. Some toner particles usually remain on the photosensitive element and must be removed by a cleaning unit after the toned image has been transferred to the copy paper. U.S. Pat. No. 3,647,293 discloses that the developer unit and cleaning unit may be combined to reduce the number of elements associated with the copying machine and thereby its size. In that system, a magnetic brush element performs the developing operation during the first revolution of a photosensitive drum. On the second revolution of the drum, a cleaning operation is performed by the magnetic brush element. The combined developing-cleaning magnetic brush element is effective to reduce the size of the electrophotographic copying machine. However, the copying speed is inevitably reduced because the photosensitive drum must rotate twice to complete a one-sheet copying operation.

U.S. Pat. No. 4,465,360 provides a photographic drum which has a circumference which is sufficiently long to incorporate two image areas. By alternating development and cleaning of the two image areas, the rate of copy production is improved over that of U.S. Pat. No. 3,647,293. However, the copying cycle is so arranged that the photosensitive drum must be rotated twice to complete a one-sheet copying operation and three times for every two copies in a multiple copying operation. This copying cycle is effective to increase the speed at which copies are produced, but does not greatly reduce the total number of revolutions of the photosensitive member necessary to produce a given number of copies.

If the photosensitive element is a belt, its life is related to the number of revolutions. So although the cycle of U.S. Pat. No. 4,465,360 is effective to increase the speed at which it may produce copies, the cycle would not greatly extend the useful life of a photosensitive belt, if used.

SUMMARY OF THE INVENTION

The present invention increases the speed with which successive copies may be produced by providing a photosensitive element which has a length sufficient to accommodate two complete images of the object to be copied. The rate of copy production is increased because one image portion of the photographic element begins the cleaning cycle while the remaining image area begins the development cycle. The copying process equalizes wear along the entire length of the photosensitive element by always alternating exposure and development from one image area of the photosensitive element to the other. The process also minimizes wear on the photosensitive element caused by excessive revolutions by eliminating a cleaning cycle after the final copy has been produced and allowing residual toner to remain on an image portion of the photosensitive element until a subsequent copying cycle is demanded.

Also included in the present invention is a combined charging and precleaning corona unit which reduces the size of the electrophotographic copying apparatus and an exposure mask which prevents undesired and unnecessary toning of the photosensitive element.

BRIEF DESCRIPTION OF THE DRAWINGS

The present invention will be more thoroughly described with reference to the accompanying drawings, wherein like numbers refer to like parts in the several views, and wherein.

DESCRIPTION OF THE PREFERRED EMBODIMENT

Figure 1:
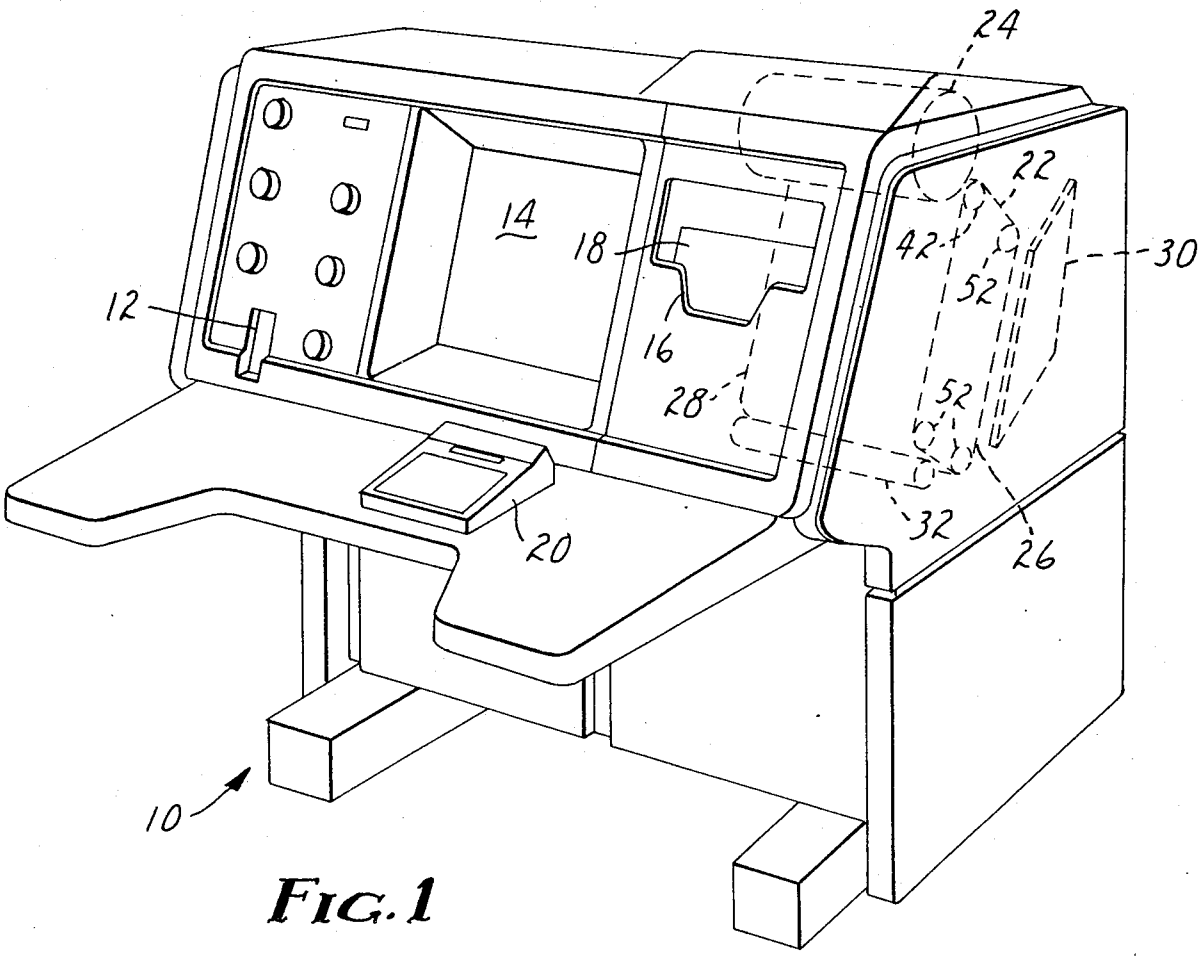
FIG. 1 is a perspective view of a microfilm reader/-printer employing the electrophotographic copying apparatus of the present invention.

FIG. 1 illustrates a microfilm reader/printer 10 which is adapted to allow the operator to either view a projected, magnified image of an object document contained on a microfilm spool (not shown) or print a hard copy reproduction of the object document. In use, the operator loads a microfilm spool into a microfilm spool slot 12 and views a magnified image of the microfilmed document on a viewing screen 14. In the printing mode, a delivery slot 16 is provided adjacent the viewing screen 14 for receiving a reproduction of the projected image in the form of a hard copy 18 produced on plain bond paper. A control panel 20 is provided to allow the operator to switch from the viewing mode wherein the image is projected onto the viewing screen 14 and the printing mode wherein the copy 18 is produced.

Major portions of the printing section of the reader/-printer 10 include a photosensitive belt 22 and a fuser roller 24. The belt 22 includes a primary or exposure image area 26 and a secondary image area 28. The primary image area 26 is imagewise exposed by light reflected from an internal mirror 30 which comprises a portion of the internal optics of the reader/printer 10.

After exposure, the primary image area 26 revolves past a combined developer/cleaner unit 32 which applies magnetic toner particles (not shown) to the photosensitive belt 22. As the belt 22 continues to revolve, a sheet of copy paper 18 is synchronously fed into contact with the belt 22 and the toner on the belt 22 is transferred thereto. The copy 18, with its transferred toner, is then placed in contact with the fuser roller 24 which rotates and is heated to permanently bond the toner particles to the copy 18. Continued rotation of the fuser roller 24 causes the copy 18 to be deposited within the copy delivery slot 16.

Figure 2:
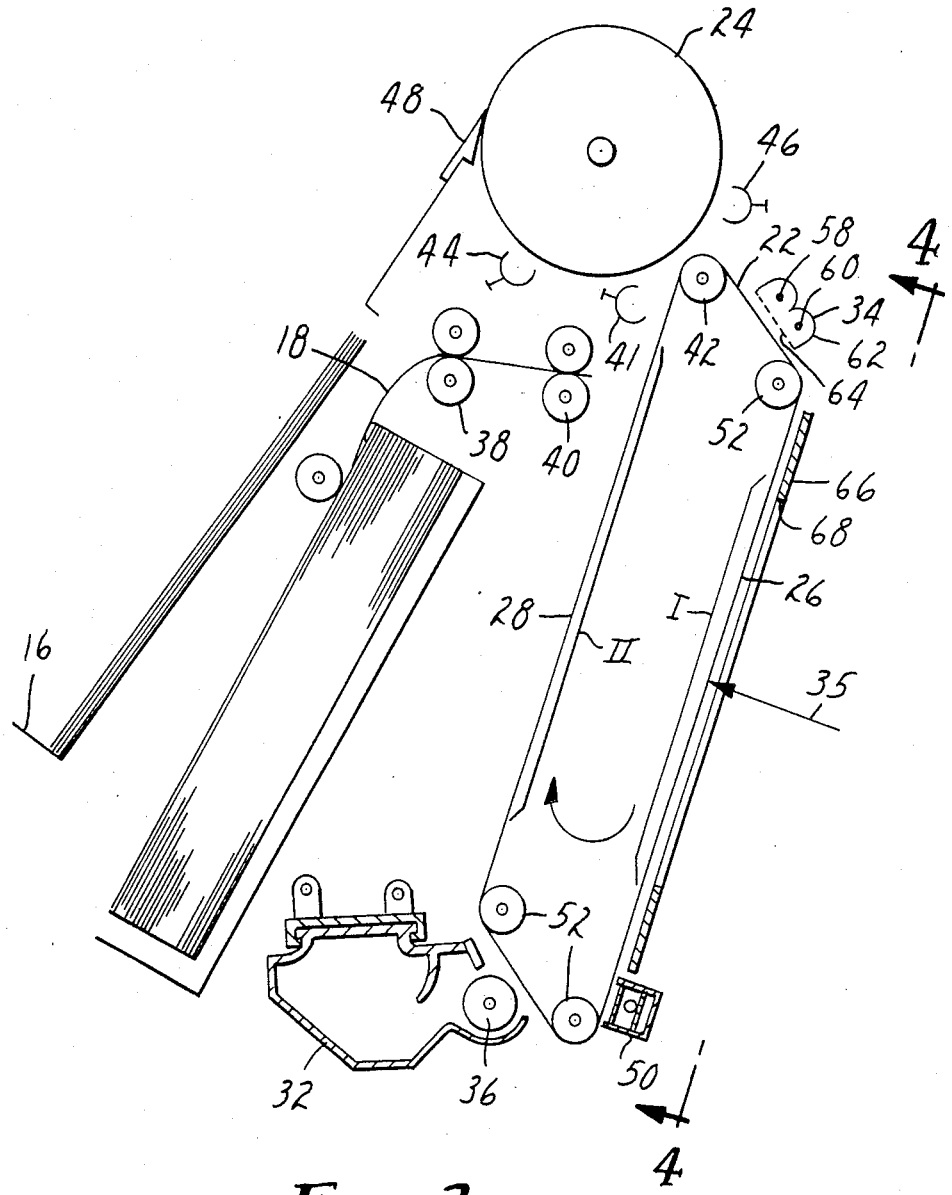
FIG. 2 is a schematic, side elevational view of the electrophotographic copying apparatus of the present invention.

The printer section of the microfilm reader/printer 10 is illustrated schematically in FIG. 2 and is substantially conventional in nature, with exceptions which will be noted herein. The printer section is adapted for use with microfilm, but it should be recognized that the printer section is adaptable to conventional copying machines and that the following description is not limited to a microfilm reader/printer 10. For example, although the printer section includes a photosensitive belt 22 in the form of a thin sheet to conserve space within the reader/printer 10, the description applies equally to a system which utilizes a cylindrical drum having a photosensitive surface, as is more common in copying machines.

The primary difference between a microfilm system and the system usually employed in copying machines is that the object document in a microfilm system is a negative object in that the information is in the form of transparent indicia on an opaque or dark background, while conventional copying machines usually operate in conjunction with positive documents wherein the informational indicia is dark and included on a white or light colored background. To produce a standard positive copy 18 of a microfilmed document, therefore, it is necessary to reverse the imaging process so that transparent indicia on a dark background are printed as dark indicia on a light background. This so called "image reversal electrophotographic process" simply involves the reversal toning of static charges applied to the photosensitive belt 22, and is described in great detail in U.S. Pat. No. 4,200,387, which is incorporated by reference. It should be recognized that the reversal system described herein may be easily adapted to the positive mode for use in more conventional copying and that the improvements contained herein are generally applicable to either system.

As explained earlier, the printing system of the present invention employs a combined developer/cleaner 32 which, through a change in biasing voltage, will operate either as a developer by applying toner particles to the photosensitive belt 22 or a cleaner by removing residual toner particles from the photosensitive belt 22. The operation of such a combined developer/cleaner 32 is described in U.S. Pat. No. 3,647,293, which is incorporated herein.

Operation of the printer section of the microfilm reader/printer 10 will be described with particular reference to FIG. 2. To develop an image and transfer this image to a sheet of copy paper 18, the photosensitive belt 22 is rotated past a combined charge and preclean corona unit 34, which is an exception to the statement above that elements of the printing section are conventional in function. The combined charger/precleaner 34 will be described in greater detail below, but for now it is sufficient to understand that the charger/precleaner 34 operates selectively to either place a negative charge of high potential on the belt 22 to charge the belt 22 for subsequent development or a negative charge of lower potential to condition the belt 22 for subsequent cleaning.

The belt 22 is an endless sheet of conductive material which is coated with an organic or inorganic photoconductive material as is well known in the copying art. The photoconductive material operates to accept a static electrical charge from the charger/precleaner 34 and retain this charge on its surface. When struck by light, the photoconductive material becomes conductive and allows these surface charges to be conducted through the photoconductive material to the underlying conductive base of the belt 22 where they may be removed, leaving modified charge areas on the belt 22 where light has struck. To develop an image, the belt 22 is revolved past the charger/precleaner 34 where a substantially uniform static electrical charge is placed on its surface. This charge is negative to accommodate the characteristics of the particular belt 22 utilized and preferably has a value of approximately −920 volts. The charged portion of the belt 22 moves to the primary or exposure image area 26 of the belt 22 which is more definitely indicated by the bracketed area I. After the belt has moved so that its charged area spans the image area I, the belt 22 is ready for imagewise exposure. This exposure is accomplished by briefly causing the belt 22 to pause in a motionless condition and flashing an exposure lamp through the microfilm. Since the microfilm is transparent in its informational areas, a light image 35 corresponding to the information contained on the microfilm is applied to the photosensitive belt 22. As discussed earlier, this light 35 causes the photoconductive material to become conductive in the light-struck areas and results in neutrally charged exposed areas on the belt surrounded by negative surface charges.

After exposure of the photosensitive belt 22, the belt 22 revolves past the developer/cleaner 32, which is biased to a negative potential of preferably approximately −700 volts. Negatively charged toner particles are placed in contact with the photosensitive belt 22 by a magnetic roller 36 and are repelled by those areas of the photosensitive belt 22 which have retained a negative charge and are attracted to the informational areas of the belt 22 which are neutral by virtue of their having been struck by light.

Continued revolution of the belt 22 moves the toned image to a position adjacent paper feed rollers 38 and 40. These rollers 38 and 40 synchronously feed copy paper 18 into registry with the toned image so that the toner may be transferred to the copy paper 18. The toner is transferred to the copy paper 18 by means of a transfer corona 41 which applies a positive static charge to the rear surface of the paper 18, which positive charge attracts the negatively-charged toner from the belt 22 to the paper 18. Continued revolution of the photosensitive belt 22 causes the paper 18 and its toned image to separate from the belt 22 at a small diameter belt drive roller 42. Separation of the paper 18 from the belt 22 is caused by the beam strength of the paper 18 which does not allow the paper 18 to follow the sharp curvature of the belt 22 around the drive roller 42.

Attachment of the paper 18 to the fuser roller 24 is accomplished by a fuser charge corona 44 which supplies the fuser roller 24 with a negative surface potential which attracts the paper 18 which has been positively charged by the transfer corona 41. Attachment of the paper 18 to the fuser roller 24 is increased by a fuser tack corona 46 which applies a further positive charge to the paper 18 to increase its attraction to the fuser roller 24.

The fuser roller 24 is heated to melt or fuse the toner particles onto the copy paper 18 and thus render the toned image permanent. The copy paper 18 and its fused image is removed from the fuser roller 24 by a stripper 48 which peels the paper 18 from the fuser roller 24 and guides the copy 18 to the copy delivery slot 16.

Unfortunately, transfer of the toner to the copy paper 18 is never truly complete and a small amount of residual toner remains on the photosensitive belt 22 after the paper 18 separates from the belt 22 at the drive roller 42. This residual toner must be removed by a cleaning operation so that unwanted toner is not transferred to the next sheet of copy paper 18.

This cleaning operation is initiated by means of the charger/precleaner 34 which applies a negative charge to the photosensitive belt and any remaining residual toner. This negative charge is of a lesser potential than the charging potential applied by the charger/precleaner 34 during the development mode, and is preferably approximately −100 to −460 volts. This precleaning charge is applied to both the belt 22 and any residual toner thereon to make the charge on the belt 22 more uniform across its surface and also to charge the residual toner to the same polarity as the belt 22 to lessen the attraction between residual toner and the photosensitive belt 22.

Continued revolution of the photosensitive belt 22 carries the residual toner past an erase lamp 50 which is activated to reduce the negative potential coating the belt 22 by conduction of the photoconductive material on the belt 22 as was explained earlier during the exposure phase of image development. The residual toner on the belt 22 is removed at the developer/cleaner 32 by changing the bias of the developer/cleaner 32 so that the unit is at or near ground potential. Since the residual toner particles on the belt 22 have a low negative charge by virtue of the precleaning charge applied by the combined charger/precleaner 34, the residual toner particles may be attracted to the developer/cleaner 32 by the magnetic roller 36 and removed from the photosensitive belt 22.

Thus far, the development and cleaning cycles described correspond to those disclosed in U.S. Pat. No. 3,647,293, with the exception of the combined charge/-precleaner unit 34. It will be noted that two complete revolutions of the photosensitive belt 22 are necessary to produce one copy 18, with the first revolution including charging, exposure, development and transfer and the second revolution including preclean charging, erase lamp exposure and cleaning. The major drawback of the system thus described and that of U.S. Pat. No. 3,647,293 is that two revolutions of the photosensitive element are necessary and thus the rate at which copies may be produced is relatively slow. Even if this slow copy delivery rate is not considered a drawback, the two revolution per copy cycle is still detrimental to the present invention because the system of the microfilm reader/printer 10 utilizes a flexible photosensitive belt 22 unlike U.S. Pat. No. 3,647,293 which utilizes a solid, cylindrical drum having a photoconductive surface. Continued or excessive rotation of such a drum is not detrimental because of its solid nature, but is detrimental to the useful life of a flexible belt 22 because the belt 22 is continually flexed at the drive roller 42 and its three idler rollers 52. This continual flexing causes fatigue within the material of the photosensitive belt 22 and decreases its useful life proportionately.

The problem of reduced life due to flexure of the belt 22 will be further addressed below, but for now it is instructive to return to the problem of slow copy production caused by the requirement of two revolutions of the photosensitive element per copy.

The use of a combined developer/cleaner 32 is useful because two procedures are combined into one unit and thus the overall size of the apparatus is reduced. However, as noted, the drawback of using a combined developer/cleaner as in U.S. Pat. No. 3,647,293 is that two revolutions of the photosensitive element is necessary to produce one copy and thus the rate at which copies may be produced is decreased. This problem has been addressed by U.S. Pat. No. 4,465,360 which is incorporated herein and which discloses a photosensitive element having a length sufficient to accommodate two complete exposure areas. In other words, the length of the surface of the photosensitive element is at least twice as long as the image to which the photosensitive element is exposed. The extended surface length of the photosensitive element allows the combined developer/cleaner 32 to be used more efficiently in that the developer/cleaner 32 can alternately develop and clean opposing halves of the photosensitive element during one revolution. Therefore, two copies can be produced by two revolutions of the photosensitive element rather than one copy as in U.S. Pat. No. 3,647,293.

The present invention incorporates the advantages disclosed by the system of U.S. Pat. No. 4,465,360 in that the length of the photosensitive belt 22 is longer than twice the length of a single exposure and thus contains two complete image areas denoted by I and II in FIG. 2. The system disclosed in U.S. Pat. No. 4,465,360, however, does not realize its full potential because that system includes features which are detrimental to its efficiency and its useful life, particularly when applied to a system which utilizes a flexible belt 22 as does the present invention.

U.S. Pat. No. 4,465,360 includes a cleaning operation, after each set of two copies, which is added to completely clean the drum in preparation for the next set of two copies. Thus if six copies are required, the photosensitive drum of U.S. Pat. No. 4,465,360 makes nine complete revolutions, six to produce the six copies and three simply to clean the drum, with one cleaning revolution occurring after each two copy-producing revolutions. This extra cleaning cycle on the third revolution decreases the rate of copy production but is not detrimental to the longevity of the photoconductive element because the element is a solid cylinder and is not flexed during revolution. The extra, third revolution, however, is detrimental to the system of the present invention because it causes additional flexing of the photosensitive belt 22 which leads to decreased useful life as explained earlier.

Also, when in the single copy mode, cycling of U.S. Pat. No. 4,465,360 is such that one of the exposure areas of the photosensitive element is used to the exclusion of the other. Since development, exposure and cleaning of the photoconductive material degrades this material, such a cycling arrangement is disadvantageous because this degradation of the photoconductive material is not equalized along the entire length of the photosensitive element. For these reasons the cycling arrangement of U.S. Pat. No. 4,465,360 is not utilized in the present invention.

Figure 3:
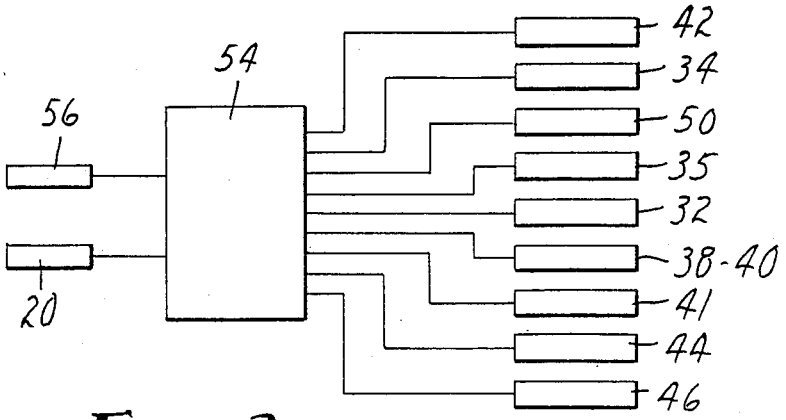
FIG. 3 is a schematic block diagram of a control system for the electrophotographic copying apparatus of the present invention.

The copying cycle of the present invention is controlled as illustrated schematically in FIG. 3 by a copy control 54 which receives signals from a belt positioning unit 56 and the reader/printer control 20. The belt positioning unit 56 relays a signal to the copy control 54 which indicates the instantaneous position of the belt during the development and cleaning cycles. The position of the belt may be sensed in any conventional manner and is conveniently done by means of timing marks on the inner surface of the photosensitive belt 22 which are detected by a photoelectric receptor and/or an encoder disk as used in U.S. Pat. No. 4,465,360. The reader/printer control 20 supplies a start command and information as to the number of copies desired. The control 54 then supplies command signals to the various elements of the development and cleaning cycles to ensure that the various units are in the proper mode and activated at the appropriate time.

Briefly stated, the control 54 conducts the copying cycle in such a manner as to ensure that development and cleaning always alternates between the two exposure areas I and II of the photosensitive belt 22, whether a series of single copies is produced or multiple copies of either an odd or even number. This cycling system ensures equalized degradation of the entire length of the photosensitive belt 22 and thereby achieves the maximum useful life of the photoconductive material possible. The maximum useful life of the photosensitive belt 22, from a flexure standpoint, is achieved by operation of the control unit 54 to stop the photosensitive belt 22 in a position wherein residual toner remains in the exposure area I between copying cycles. In other words, the final cleaning revolution of U.S. Pat. No. 4,465,360 is eliminated and the photosensitive belt 22 is not cycled through this final cleaning revolution after the production of copies is completed. Thus the useful life of the photosensitive belt 22 is increased because flexure of the belt around the drive roller 42 and the idler rollers 52 is reduced to a minimum.

Cycling of the photosensitive belt 22 through a copying cycle to produce one copy is illustrated in Table I wherein the first column indicates successive steps through the copying cycle, the second column indicates the position of the belt 22, the third and fourth columns indicate the status of the image areas I and II as they proceed through the cycle and starting from the position shown in FIG. 2, the fifth column indicates the position of image area I with respect to the exposing light 35 and the sixth column indicates the position of the cycle at which copies are delivered.

means that the image area has been imagewise exposed by a flash of light 35 from the optical system of the reader/printer 10, "developed" means that toner particles have been applied to the photosensitive belt 22 in its image area by the developer/cleaner 32 and "residual toner" means that most of the toned image has been transferred to the copy paper 18, that the belt 22 and any residual toner particles have been subjected to a static electrical charge by the charger/precleaner unit 34 and that the belt 22 has not yet been cleaned. Blank portions in the status columns of Table I indicate that the appropriate image area I or II of the photosensitive belt 22 has not been subjected to any development or cleaning operation and its status remains unchanged.

Table I indicates that the image area I which was in the light path 35 before the cycle started finishes the cycle in the opposite position, i.e. position II. The image areas I and II effectively "switch sides" in the process of producing a single copy. Therefore, the image area that began the cycle in the position I in FIG. 2 finishes the cycle in the position originally occupied by image area II and the photosensitive belt 22 turns through one and one-half revolutions to produce a single copy. It will be noticed from the status columns of Table I that the status of these areas I and II are identical at the beginning and end of the cycle, except that their relative positions are switched. The purpose of this particular cycling is to ensure that successive copies alternate between the image areas I and II, even if separate demands for a single copy are processed. It is essential to recognize that what was image area I at the beginning of one single-copy cycle becomes image area II at the beginning of the next single-copy cycle.

Another feature of the cycle reflected in Table I is that residual toner is always left on that image area of the photosensitive belt 22 which is in the light path 35 and thus immediately prior to the erase lamp 50 after the completion of a copying cycle. This residual toner is, therefore, not cleaned from the photosensitive belt 22 until a subsequent copy is demanded and another print cycle begins. In contrast to U.S. Pat. No. 4,465,360, extra revolutions of the photosensitive belt 22 are not added at the completion of a print cycle merely to clean

TABLE I

| | | 1 COPY | | | |
|---|---|---|---|---|---|
| | | Status of Image Area | | | |
| Cycle Step | Position of Belt 22 | I | II | Position of Image Area I | Copy Delivery |
| 1 | At rest | Residual Toner | Cleaned | In light path | |
| 2 | After ½ revolution | Cleaned | Charged | Out of light path | |
| 3 | Pause | — | Exposed | — | |
| 4 | After ½ revolution | — | Developed | In light Path | |
| 5 | After ½ revolution | — | Residual Toner | Out of light path | 1 copy |

In Table I "cleaned" means that the photosensitive belt 22 has rotated past the developer/cleaner 32 and has had residual toner removed, "charged" means that the appropriate image area I or II has passed the combined charger/precleaner 34 and received a static electrical charge of relatively high potential, "exposed"

the belt. Elimination of this immediate cleaning cycle has no adverse effects on subsequent copies and extends belt 22 life by reducing belt 22 flexure.

Table II indicates cycling of the present invention when two copies are demanded. The various columns reflect the same information presented in Table I.

TABLE II

| | | 2 COPIES | | | |
|---|---|---|---|---|---|
| | | Status of Image Area | | | |
| Cycle Step | Position of Belt 22 | I | II | Position of Image Area I | Copy Delivery |
| 1 | At rest | Residual Toner | Cleaned | In light path | |
| 2 | After ½ revolution | Cleaned | Charged | Out of light path | |

TABLE II-continued

| Cycle Step | Position of Belt 22 | 2 COPIES Status of Image Area I | Status of Image Area II | Position of Image Area I | Copy Delivery |
|---|---|---|---|---|---|
| 3 | Pause | — | Exposed | — | |
| 4 | After ½ revolution | Charged | Developed | In light path | |
| 5 | Pause | Exposed | — | — | |
| 6 | After ½ revolution | Developed | Residual Toner | Out of light path | 1 copy |
| 7 | After ½ revolution | Residual Toner | Cleaned | In light path | 2 copies |

Table II indicates that two copies are produced by two complete revolutions of the photosensitive belt 22 and, like the production of a single copy, alternate image areas I and II are always used to produce successive copies. Table II also indicates that residual toner is left on the belt 22 after the conclusion of the copying cycle and that this residual toner is always positioned immediately prior to the erase lamp 50, in the light path 35. Thus, the photosensitive belt 22 after producing two copies is left in a configuration which is identical to the belt 22 after a single copy has been produced. It should be noted from Table II that since a copy is produced between the half revolution where the image area I or II proceeds from "developed" to "residual toner", the cycle of the present invention is different from that of U.S. Pat. No. 4,465,360 since two copies exit the reader/printer 10 in quick succession after a delay. The average time required to deliver two copies is equivalent to that of U.S. Pat. No. 4,465,360, but the order in which the copies is produced is somewhat changed. If three or more copies are demanded, the rate of copy production will be faster than that of U.S. Pat. No. 4,465,360 because the cycle of that patent adds an unproductive cleaning revolution after the production of each two copies.

Table III illustrates the copying cycle associated with the production of an even number of multiple copies (2N copies, where N equals any positive integer). The columns in Table III reflect the same information as in the previous Tables.

TABLE III

| Cycle Step | | Position of Belt 22 | 2N COPIES Status of Image Area I | Status of Image Area II | Position of Image Area I | Copy Delivery |
|---|---|---|---|---|---|---|
| 1 | | At rest | Residual Toner | Cleaned | In light path | |
| 2 | | After ½ revolution | Cleaned | Charged | Out of light path | |
| 3 | | Pause | — | Exposed | — | |
| 4 | | After ½ revolution | Charged | Developed | In light path | |
| 5 | | Pause | Exposed | — | — | |
| 6 | | After ½ revolution | Developed | Residual Toner | Out of light path | 1 copy |
| 7 | 1A | After ½ revolution | Residual Toner | Cleaned | In light path | 2 copies |
| | 2A | After ½ revolution | Cleaned | Charged | Out of light path | |
| | 3A | Pause | — | Exposed | — | |
| | 4A | After ½ revolution | Charged | Developed | In light path | |
| | 5A | Pause | Exposed | — | — | |
| | 6A | After ½ revolution | Developed | Residual Toner | Out of light path | 3 copies |
| 1B | 7A | After ½ revolution | Residual Toner | Cleaned | In light path | 4 copies |
| 2B | | After ½ revolution | Cleaned | Charged | Out of light path | |
| 3B | | Pause | — | Exposed | — | |
| 4B | | After ½ revolution | Charged | Developed | In light path | |
| 5B | | Pause | Exposed | — | — | |
| 6B | | After ½ revolution | Developed | Residual Toner | Out of light path | 5 copies |
| 7B | | After ½ revolution | Residual Toner | Cleaned | In light path | 6 copies |

Table III illustrates that, for any even number of copies, the cycling of the present invention is equivalent to a number of the print cycles of Table II performed in sequence. Therefore, for the six copies produced in Table III, the cycle of Table II is repeated three times with the last step of the previous cycle corresponding to the first step of the subsequent cycle. The copy cycles may repeat indefinitely, with two copies produced for each two complete revolutions of the photosensitive belt 22. Table III also indicates that the status of the photosensitive belt 22 at the completion of any even number of multiple copy cycles remains the same as the status of the belt 22 at the completion of either one-copy cycling or two-copy cycling.

Table IV illustrates the copying cycle steps of the present invention when an odd number of multiple copies are produced (2N+1 copies, where N equals any positive integer). As before, column information is the same as that provided in any previous Table.

TABLE IV

| Cycle Step | Position of Belt 22 | 2N + 1 COPIES Status of Image Area I | Status of Image Area II | Position of Image Area I | Copy Delivery |
|---|---|---|---|---|---|
| 1 | At rest | Residual Toner | Cleaned | In light path | |
| 2 | After ½ revolution | Cleaned | Charged | Out of light path | |
| 3 | Pause | — | Exposed | — | |
| 4 | After ½ revolution | Charged | Developed | In light path | |

TABLE IV-continued

| Cycle Step | Position of Belt 22 | 2N + 1 COPIES Status of Image Area I | Status of Image Area II | Position of Image Area I | Copy Delivery |
|---|---|---|---|---|---|
| 5 | Pause | Exposed | — | — | |
| 6 | After ½ revolution | Developed | Residual Toner | Out of light path | 1 copy |
| 1A 7 | After ½ revolution | Residual Toner | Cleaned | In light path | 2 copies |
| 2A | After ½ revolution | Cleaned | Charged | Out of light path | |
| 3A | Pause | — | Exposed | — | |
| 4A | After ½ revolution | — | Developed | In light path | |
| 5A | After ½ revolution | — | Residual Toner | Out of light path | 3 copies |

Table IV illustrates that an odd number of multiple copies is produced by combining an appropriate number of cycles according to Table II with a final cycle corresponding to the cycle of Table I, with steps 1–7 corresponding to the cycle of Table II and steps 1a–5a corresponding to the steps of Table I. Although Table IV only illustrates the production of three copies, it should be apparent that any number of copies can be produced by repeating steps 1–7 and adding one 5-step cycle corresponding to Table I. This would be equivalent of adding the cycles of Table III to a single cycle of Table I. Table IV also illustrates that the photosensitive belt 22 finishes its copying cycle in the same configuration as that assumed by the belt 22 when either an even number of multiple copies or a single copy is produced. Thus no matter what the prior history of copy production, the belt 22 is always in the same status at the beginning of a subsequent cycle, with residual toner in the light path 35 and just prior to the erase lamp 50.

The microfilm reader/printer 10 thus far described possesses several advantages over the prior art. First, both the present invention and U.S. Pat. No. 4,465,360 are more efficient that the system of U.S. Pat. No. 3,647,293 in that more efficient use of a combined developer/cleaner 32 is achieved by utilizing a photosensitive element which has a surface length which is long enough to accommodate two exposure areas. This allows the combined developer/cleaner 32 to develop one half of the belt 22 and clean the remaining portion of the belt 22 while the first is being processed.

Second, the present invention is advantageous when compared to the system of U.S. Pat. No. 4,465,360 since the system of the present invention always alternates between the two image areas I and II of the photosensitive belt 22 in producing successive copies whereas the photosensitive element of U.S. Pat. No. 4,465,360 uses one portion repetitively if a series of single copies is desired. The advantage of always alternating image areas is that degradation of the photosensitive belt 22 is equalized over its length.

Third, the cycle of the present invention is advantageous when compared to the cycle of U.S. Pat. No. 4,465,360 in that a cleaning revolution after the production of each two-copy set is eliminated and residual toner is allowed to remain on the photosensitive belt 22 between copy cycles. Elimination of this unnecessary cleaning is advantageous because flexural damage to the photosensitive belt 22 is reduced and the expected life of the belt 22 is increased.

As was alluded to earlier, the present invention also includes a combined charging and precleaning corona unit 34 which is used during the development cycle to charge the photosensitive belt 22 to a relatively high potential and during the cleaning cycle to charge the photosensitive belt 22 and any residual toner to the same polarity as that applied during the development cycle but at a lower potential. Although a negative polarity is used in the present invention, such a polarity is merely used because of the peculiarities of a particular photosensitive belt 22 utilized. Combination of the charging and precleaning functions into a single unit will be useful in either polarity, depending upon the characteristics of the remaining elements of the copying system.

The utilization of a single polarity to both charge and preclean a photosensitive element 22 has been disclosed in U.S. Pat. No. 4,233,386 wherein separate corona devices are used for the charging and precleaning functions, even though these two corona devices are of the same polarity. Thus while U.S. Pat. No. 4,233,386 recognized that a single polarity may be used to charge and preclean a photosensitive element, that patent did not recognize that the two corona units may be combined.

U.S. Pat. Nos. 4,335,420 and 4,456,365 describe methods of changing the effective charging voltage of a corona unit and their teachings are incorporated herein. The purpose of changing the voltage in these patents is to compensate for degradation of the photosensitive element and the potential is changed serially as the photosensitive element ages. These patents do not consider or recognize that it may be useful to alter the charging potential to perform different functions in the copying process.

The combined charging and precleaning corona device 34 of the present invention is of the scorotron type in that the unit contains primary corona wires 58 and 60 within a grounded housing 62 and a wire mesh grid 64 interposed between the corona wires 58 and 60 and the photosensitive belt 22. With the corona wires 58 and 60 remaining at a given current, the potential actually imparted to the photosensitive belt 22 may be controlled and varied by selection and change of the potential of the wire grid 64. This potential is preferably changed by the arrangement described in U.S. Pat. No. 4,335,420 in which a switch is used to connect the grid 64 to ground through Zener diodes of differing values. The switch may also connect the grid 64 directly to ground if desired, and the switch position may be controlled by the copy control 54.

It has been found effective to charge the grid 64 to a potential of about −820 volts during charging of the photosensitive belt 22 so that the belt receives a charge of about −920 volts. When used as a precleaning corona it has been found effective to ground the grid 64 so that a charge of between about −100 to −460 volts is produced on the photosensitive belt 22 when the corona wires 58 and 60 are at the same current as during charging. Since only a single potential and ground are applied to the grid 64, it may be expedient to eliminate the Zener diodes described above and switch the grid 64 between its own power supply, independent of the power supply to the corona wires 58 and 60, and ground.

The advantage of providing a combined charging/-precleaning unit 34 is that one device surrounding the photosensitive belt 22 may be eliminated and consequently the overall size of the printing section of the reader/printer 10 may be reduced.

Figure 4:
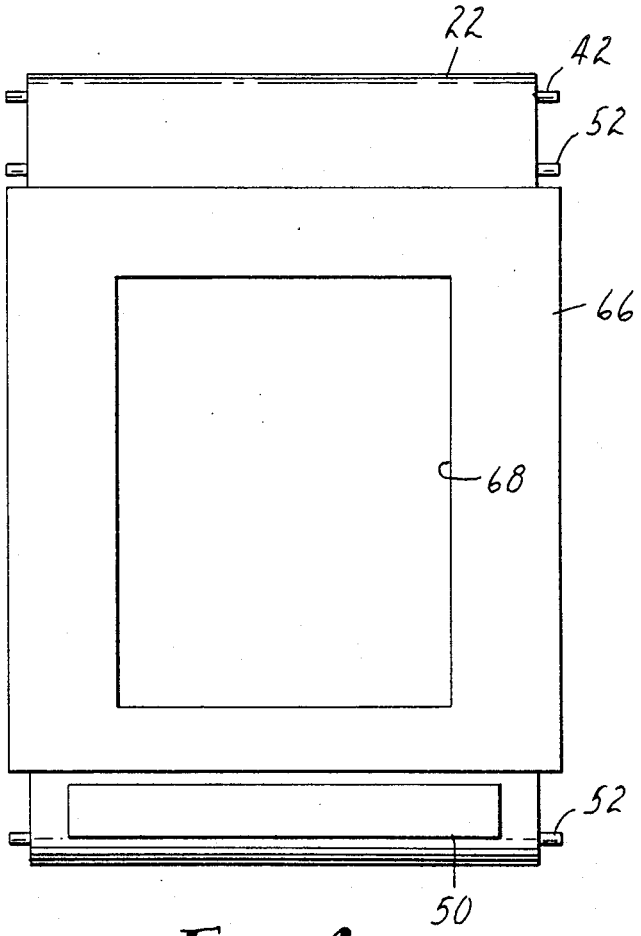
FIG. 4 is a front elevational view of the electrophotographic copying apparatus taken generally from the perspective of the line 4—4 of FIG. 2.

Also incorporated into the present invention is a light mask 66 which is illustrated in FIGS. 2 and 4. The light mask 66 is a shield which includes an aperture 68 of a desired size which allows the exposing light 35 to access a reduced portion of the photosensitive belt 22. The aperture 68 is preferably of a size which is smaller than the size of the copy paper 18 utilized and thus prevents the imaging light 35 from exposing a surface area of the belt 22 which is equal in size to the copy paper 18. Preferably the aperture 68 is smaller than the copy paper 18 utilized such that a margin of approximately 6 to 7 mm is provided on each edge of the exposing image relative to the copy paper 18. In other words, the aperture 68 is so dimensioned to provide an exposed area on the photosensitive belt 22 which is from 12 to 14 mm narrower and shorter than the width and length of the copy paper 18.

The light mask 66 may be either an opaque material such as metal or may be a translucent material such as plastic so long as the plastic has an optical density of approximately 1.0 or more. The purpose of the light mask 66 is to prevent exposure and thus subsequent toning of the borders of the exposure area on the photosensitive belt 22 so that toner in these areas is not transferred to the copy paper 18. Since object documents do not usually contain information within these margin areas, no loss of information is entailed by the use of the light mask 66 and prevention of exposure within the margin areas. As a result of eliminating some possible errant toning of the belt 22, the inside of the reader/-printer 10 will remain cleaner and, as an added benefit, less toner will be consumed.

Use of the light mask 66 is effective when a negative object document and a reversal imaging process is utilized, as is the case in the present invention. This is because most microfilmed object documents have a dark background and transparent informational indicia and the transparent areas are those which receive toner during the development process. If the object document is slightly misaligned on the microfilm, light will not be blocked at the document's edge and will expose the photosensitive belt 22. This exposed margin area will be toned but does not contain any useful information. Toner in this area is thus wasted, may contaminate the reader/printer 10 and produces an objectionable black border on the copy 18.

Although the light mask 66 is indicated as being positioned immediately adjacent the photosensitive belt 22, it should be recognized that such a mask 66 could be positioned anywhere along the light path so long as it intercepts that portion of the image which corresponds to margins of the preferred dimensions.

Although the present invention has been described with reference to only a single embodiment, it is recognized that many modifications will be apparent to those skilled in the art. All such modifications which fall within the spirit and scope of the appended claims are intended to be included in the invention.

We claim:

1. An electrophotographic copying apparatus including a photosensitive element and a development station, comprising:

a combined charging/precleaning corona unit which may be selectively activated to impart an electrical charge of a given polarity and potential to said photosensitive element prior to development and an electrical charge of said given polarity, but at a reduced potential, subsequent to development; and switch means for selectively activating said combined corona unit and changing said potential.

2. An electrophotographic copying apparatus according to claim 1 wherein said combined charging/-precleaning corona unit is of the scorotron type in that said corona unit includes at least one corona wire and a grid disposed between said corona wire and said photosensitive element, wherein said charge potential is changed by changing an electrical bias applied to said grid, and wherein said switch means comprises means for changing said bias applied to said grid.

3. An electrophotographic copying apparatus according to claim 2 wherein said means for changing said bias includes a power supply selectively connected to said grid.

4. An electrophotographic copying apparatus according to claim 2 wherein said means for changing said bias includes an electrical circuit between said grid and ground potential and at least one Zener diode which may be selectively inserted into said electrical circuit.

5. An electrophotographic copying apparatus including an endless photosensitive element, a development station and a cleaning station, comprising:

a single, combined charging/precleaning corona unit means for performing all charging functions associated with development and cleaning of said photosensitive element, said combined corona unit means selectively operating to impart an electrical charge of a given polarity and potential to said photosensitive element prior to development in one mode and an electrical charge of said given polarity, but at a reduced potential, prior to cleaning in another mode; and means for selectively operating said combined corona unit means in one or the other of said modes during operation of said electrophotographic copying apparatus.

* * * * *

UNITED STATES PATENT AND TRADEMARK OFFICE

CERTIFICATE OF CORRECTION

PATENT NO. : 4,652,114

DATED : March 24, 1987

INVENTOR(S) : JAMES F. SOBIESKI

It is certified that error appears in the above-identified patent and that said Letters Patent is hereby corrected as shown below:

On the title page:

Block [75]: Delete "Robert A. Muehlhausen, Marine, both"

Signed and Sealed this

Thirteenth Day of October, 1987

*Attest:*

DONALD J. QUIGG

*Attesting Officer*

*Commissioner of Patents and Trademarks*